US005575139A

United States Patent [19]

Green

[11] Patent Number: 5,575,139

[45] Date of Patent: Nov. 19, 1996

[54] NON-SLIP SADDLE PAD

[75] Inventor: Chris L. Green, Clovis, Calif.

[73] Assignee: Form To Fit, Pinedale, Calif.

[21] Appl. No.: 576,391

[22] Filed: Dec. 21, 1995

Related U.S. Application Data

[63] Continuation of Ser. No. 233,385, Apr. 26, 1994, abandoned.

[51] Int. Cl.[6] ..... B68C 1/12

[52] U.S. Cl. ..... 54/66

[58] Field of Search ..... 54/44.7, 65, 66, 54/67

[56] References Cited

U.S. PATENT DOCUMENTS

| | | | |
|---|---|---|---|
| 1,698,232 | 1/1929 | Katz | 54/65 |
| 2,072,188 | 3/1937 | Tauber | 54/66 |
| 5,018,340 | 5/1991 | Marshall | 54/66 X |
| 5,119,618 | 6/1992 | Streck | 54/66 |

*Primary Examiner*—Robert P. Swiatek

*Attorney, Agent, or Firm*—Dickinson, Wright, Moon, Van Dusen & Freeman

[57] ABSTRACT

A saddle pad for use on horses or other animals which provides a stable and secure buffer between the animal and a saddle or harness. The pad of the present invention avoids the slippage and play (movement) associated with ordinary saddle pads by providing a layered saddle pad, the lowest layer of which is made of an open-celled foam from which the bottom surface skin has been stripped off. The open cells of the stripped foam come into direct contact with the back of the animal and act as miniature suction cups over the entire bottom of the pad providing good adhesion and preventing the pad (and hence, any saddle mounted on it) from slipping around while in use.

17 Claims, 2 Drawing Sheets

NON-SLIP SADDLE PAD

This is a continuation of U.S. application Ser. No. 08/233,385 which was filed on Apr. 26, 1994, now abandoned.

BACKGROUND OF THE INVENTION

The present invention relates to animal riding saddle pads, and more particularly to a stable and slip resistant saddle pad that is ideal for competition use.

FIELD OF THE INVENTION

Saddle pads are widely used in connection with riding saddles or harnesses in order to protect the back of the animal (usually a horse) from the saddle or harness itself. A typical saddle pad provides a cushioned layer between the back of the horse and the saddle or harness. One of the consequences of the added layer of cushioning provided by the saddle pad is the potential hazard to the animal from chafing and high wear areas as well as the accumulation of moisture (animal perspiration) between the pad and the animal. Another consequence is increased play (looseness) between the pad itself and the animal.

The first problem (wear and perspiration) has been addressed by saddle pads disclosed in a number of U.S. Patents. However, the second problem (looseness) has not. It is the looseness/slippage/stability problem that is solved by the present invention.

U.S. Pat. No. 4,683,709 (Vasko, et al) describes a saddle pad having a lower layer of moisture-absorbing wool felt next to the horse's coat. U.S. Pat. No. 4,695,496 (Lee) describes a skin protective pad having a bottom layer consisting of a plurality of elongated hydrophobic fibers which wick moisture and perspiration away from the body of the animal. U.S. Pat. No. 4,827,701 (Gonzales) describes a pad having an upper and lower pad surrounding an intermediate cushion. U.S. Pat. Nos. 5,018,341 and 5,058,367 (both to Evertson) describe a specially contoured unitary, molded pad made of shock absorbing material. The pads described in all of these patents suffer from the same looseness/slippage/stability drawback. Although each of these pads works to provide comfort to the animal and rider, as well as some removal of perspiration, the saddle which rests on such a pad suffers from a great deal of movement which is not acceptable in competitive riding.

U.S. Pat. No. 4,136,506 (Miller) purports to address the slippage problem through a pair of contoured panels which form pockets or slots on either side into which corresponding panels of the saddle itself may be inserted. However, the invention of the Miller patent does not solve the problem of the slippage of the pad itself on the back of the animal. The material out of which this saddle pad is made is loosely described as "material capable of providing soft and comfortable protection from the saddle during use" with listed examples of synthetic sheepskin, linen, cotton, wool, plastic and/or cellulosic materials.

U.S. Pat. No. 4,974,397 (Ricken) describes a saddle pad having multiple layers including a sheet of shock absorbing polyurethane foam (24) under which a sheet of felt (26) is attached. It is unclear whether the foam or the felt comes into contact with the back of the animal. However, the foam is claimed as having a top surface and a bottom surface, so any contact between the foam and the animal is indirect. U.S. Pat. No. 5,119,618 (Streck) describes a saddle pad having many layers of materials between the saddle and the back of the animal. The lowest layer is claimed as flexible sheeting material and described as neoprene foam which may have a thin layer of nylon sewn around it.

SUMMARY OF THE INVENTION

The present invention avoids the slippage and play (movement) associated with ordinary saddle pads by providing a layered saddle pad, the lowest layer of which is made of an open-celled foam from which the bottom surface skin has been stripped off. The open cells of the stripped foam come into direct contact with the back of the animal and act as miniature suction cups across the entire bottom surface of the pad providing good adhesion and preventing the pad (and any saddle mounted thereon) from slipping around while in use. A series of openings penetrating through all layers are provided to remove perspiration from the animal.

It is therefore a primary object of the present invention to provide a very stable animal saddle pad for use between a saddle or harness and an animal that prevents slippage during use.

It is another important object of the present invention to provide a stable means for securing a saddle or harness to the back of an animal for use in competitive riding.

It is another important object of the present invention to provide a cushioned saddle pad that is comfortable to the animal and to the rider, and which provides a high degree of stability while in use.

It is another important object of the present invention to provide a cushioned, contoured saddle pad that conforms to the shape of the back of an animal, and which provides a high degree of stability while in use.

It is another important object of the present invention to provide a cushioned, contoured, malleable saddle pad that allows for removal of perspiration from the back of an animal, and which provides a high degree of stability while in use.

Additional objects will become apparent from the detailed description and the claims herein.

DETAILED DESCRIPTION OF THE DRAWINGS

Figure 4:
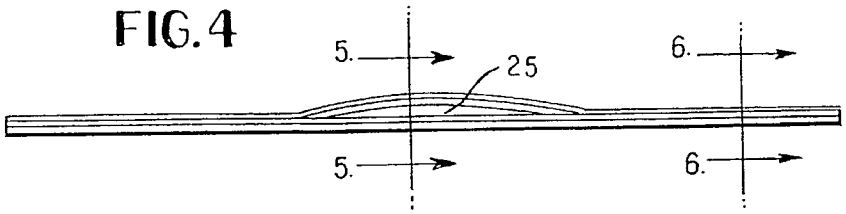
FIG. 4 is a side elevational view of the present invention.

Referring to the drawings wherein like reference characters designate like or corresponding parts throughout the several views, and referring to FIGS. 1–4, it is seen that the present invention, generally 20, in a contoured saddle pad having an upper surface 21 upon which a saddle or harness is placed, and a lower surface 22 which comes into contact with the back of an animal. The pad 20 is made of layers of flexible material so that it may be draped over the back of an animal and conform to the shape of the animal. FIG. 4 shows an elevated central area 25 on upper surface 21 which is designed to more closely fit the underside of a saddle.

Figure 5:
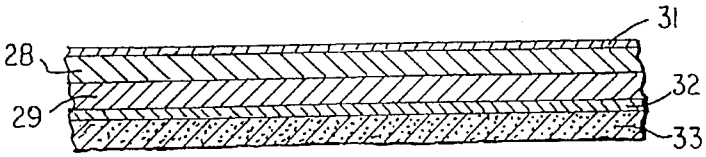
FIG. 5 is a cut away side view along line 5—5 of FIG. 4 showing the central layers thereof.
Figure 6:
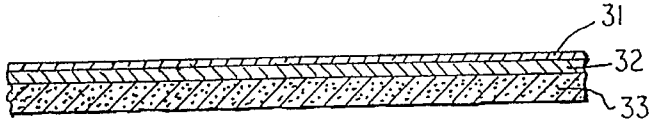
FIG. 6 is a cut away side view along line 6—6 of FIG. 4 showing the outer layers thereof.

Referring particularly to FIGS. 4, 5 and 6, it is seen that the saddle pad 20 is comprised of several different layers. The top layer 31 is a thin sheet of durable flexible material (such as vinyl, nylon or wool) which provides an outer covering for the pad 20 onto which the saddle or harness is placed. Layer 31 should provide sufficient friction to make good contact with and prevent any slippage of the saddle itself on the pad.

The next two layers 28 and 29 are only found in the central section of the pad which is built up in order to conform more readily to the saddle or harness (see FIG. 5). These built up layers 28 and 29 may be made of any suitable padded material including foam, wool, synthetic sheepskin, linen, cotton, or plastic.

Below the built up layers is a rigid piece 32 which is found throughout the pad. Piece 32 provides the pad 20 with a defined shape which may be designed to accommodate an English-style saddle (as in FIG. 1), a Western-style saddle (as in FIG. 8), or some other particular style of saddle or harness. Although piece 32 is rigid, it is still flexible enough to allow the pad to be draped over the back of an animal in order to conform to the animal.

Figure 7:
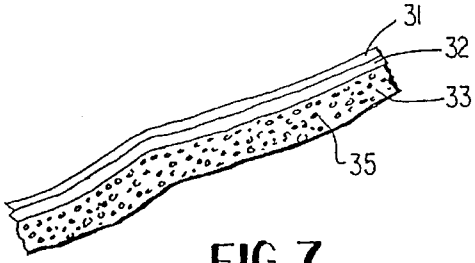
FIG. 7 is a close up bottom view of the invention showing detail of the lower layer of open-celled foam from which the skin has been stripped off exposing the open cells.
Figure 2:
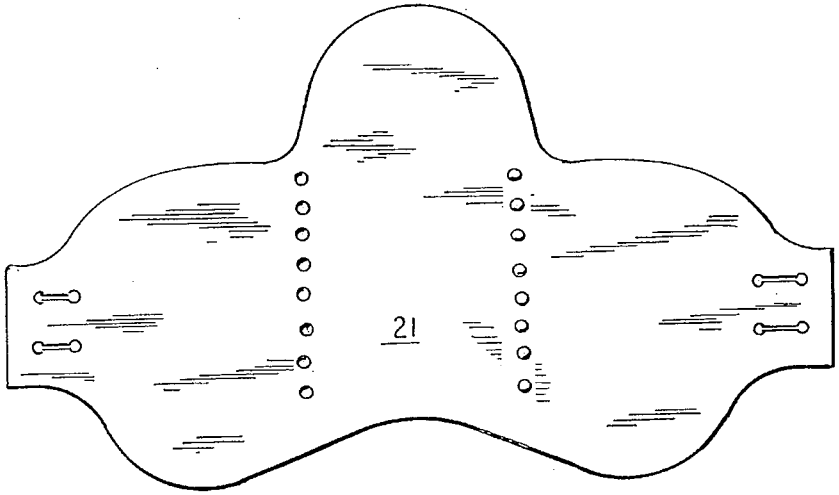
FIG. 2 is a top view of the invention.
Figure 3:
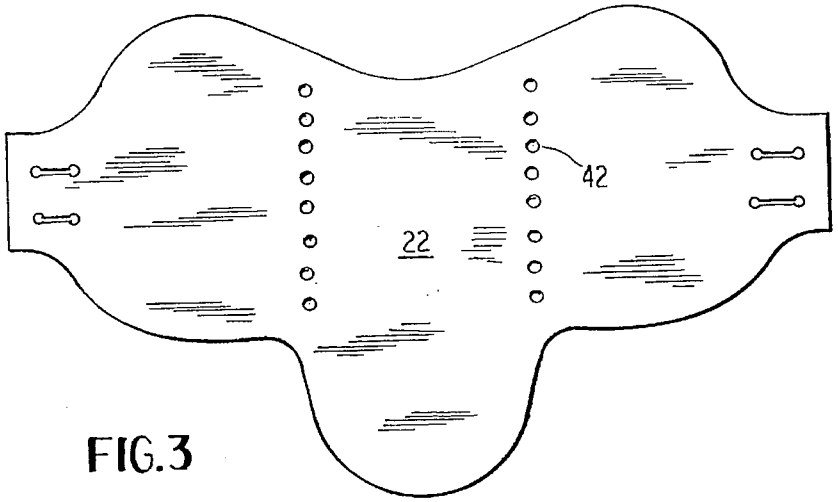
FIG. 3 is a bottom view of the invention showing the perspiration openings therein.

The bottom layer 33 is made of an open-celled foam material from which the lower surface has been stripped off. Layer 33 covers the entire bottom surface of the pad 20. By stripping the skin off this foam layer 33, the open cells 35 of which the foam layer is made are exposed directly to the back of the animal (see FIG. 7). When the cells 35 come into contact with the back of the animal and are pressed against the animal by the weight of the saddle or rider, cells 35 form hundreds of tiny suctions which tend to hold the pad 20 in place against the animal. Perspiration from the animal is evacuated through openings 42 helping to create an airtight seal between the foam layer 33 and the animal, and avoiding buildup which might lead to chaffing or other injury.

Figure 1:
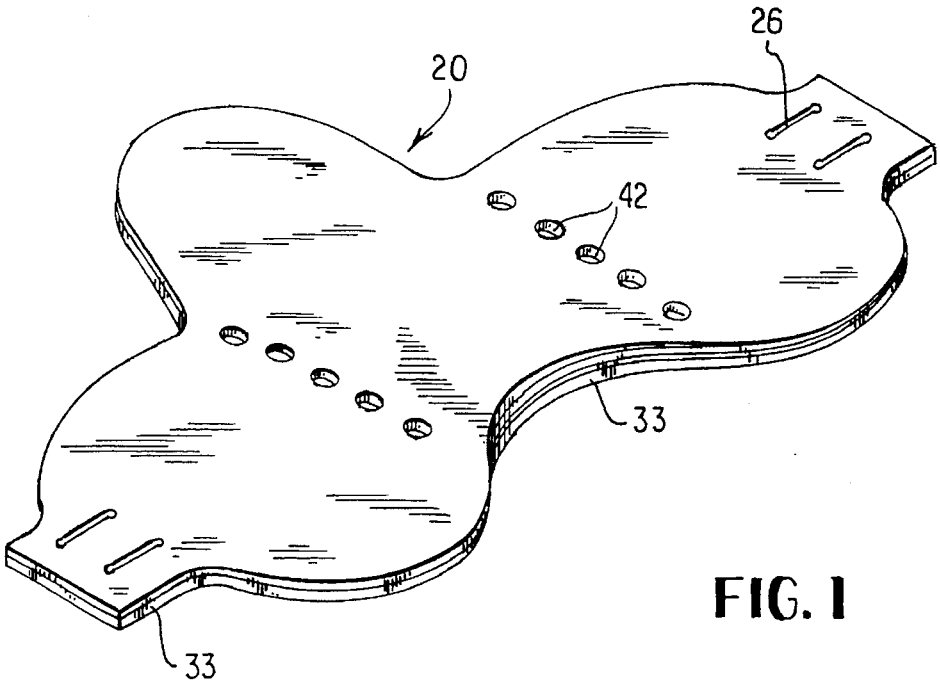
FIG. 1 is a perspective view of the contoured embodiment of the present invention.
Figure 8:
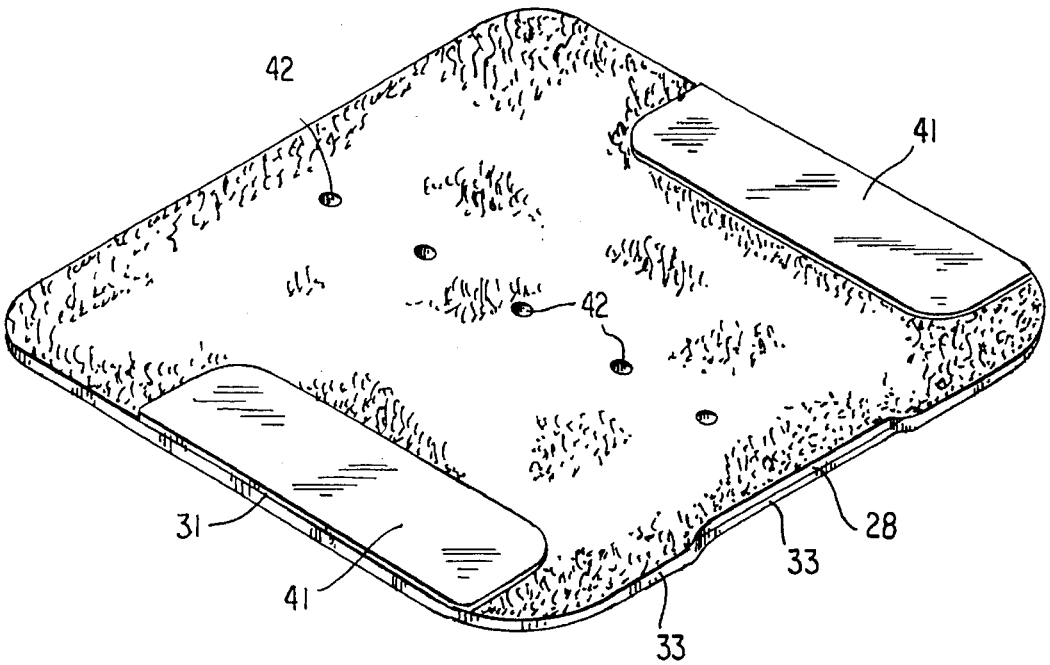
FIG. 8 is a perspective view of an alternative embodiment of the invention.

In the alternative embodiment shown in FIG. 8, it is seen that the upper surface 31 of the pad 40 is made of wool or a brushed synthetic fiber, and that there is a slightly raised central area formed by layer 28. Two side panels 41 are also provided on the upper surface for better friction and attachment to the saddle. As with the original embodiment, lower layer 33 is also made of the open-celled foam material from which the skin has been stripped back to reveal the cells themselves 35 that may adhere to the back of the animal. A series of openings 42 are provided to ventilate perspiration away from the animal. Other different shapes and contours of the present invention may be made without departing from the scope thereof.

DESCRIPTION OF THE PREFERRED EMBODIMENTS

In the preferred embodiment the saddle pad of the present invention is provided with a lower layer of open-celled flexible foam (e.g. neoprene) from which the skin has been stripped from the bottom. The exposed open cells of the foam then come into direct contact with the back of the animal and, even in the presence of perspiration, these cells form hundreds of tiny suctions which help to hold the pad in place on the animal. The remaining layers of the pad may be built up in order to conform to the different styles and designs of saddles and harnesses, and to provide a slightly rigid layer which defines the shape of the pad.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An improved saddle pad comprising a plurality of contoured layers of flexible sheeting material, the lowest layer of which is made of foam from which the bottom surface skin has been stripped off whereby a nonsmooth exposed surface is formed that is able to create a plurality of tiny suctions when placed into direct contact with the back of an animal providing good adhesion to the animal thereby preventing the pad from slipping while in use.

2. The saddle pad described in claim 1 wherein said lowest foam layer is comprised of neoprene foam.

3. The saddle pad described in claim 2 wherein a plurality of perforations are provided which penetrate all of the layers of the pad in order to allow animal perspiration to escape from under the pad.

4. The saddle pad described in claim 3 wherein a layer of rigid material is disposed immediately above and attached to said foam layer.

5. The saddle pad described in claim 4 wherein a plurality of layers of flexible sheeting material are disposed above said rigid layer.

6. The saddle pad described in claim 5 wherein an upper covering layer durable sheeting material is disposed above said plurality of layers of flexible sheeting material.

7. The saddle pad described in claim 6 wherein the pad has an English style.

8. The saddle pad described in claim 6 wherein the pad has a Western style.

9. A saddle pad comprising a flat layer of flexible material made of a skin-covered foam having a top and bottom surface from which the bottom surface skin has been stripped off whereby a nonsmooth exposed surface is formed that is able to create a plurality of tiny suctions when placed into direct contact with the back of an animal providing good adhesion to the animal thereby preventing the pad from slipping while in use.

10. The saddle pad described in claim 9 wherein the top surface of said foam layer is attached to another layer of flexible sheeting material.

11. The saddle pad described in claim 10 wherein a layer of rigid material is disposed between said foam layer and said layer of flexible sheeting material.

12. The saddle pad described in claim 11 wherein a plurality of perforations are provided which penetrate all of the layers of the pad in order to allow animal perspiration to escape from under the pad.

13. The saddle pad described in claim 12 wherein the pad has an English style.

14. The saddle pad described in claim 12 wherein the pad has a Western style.

15. The saddle pad described in claim 9 wherein said foam layer is comprised of neoprene.

16. A saddle pad comprising a flexible foam layer having a nonsmooth exposed surface formed by removal of at least a portion of at least one surface skin, said exposed surface is able to create a plurality of tiny suctions when placed in contact with an animal thereby preventing the pad from slipping while in use.

17. The saddle pad described in claim 16 wherein said pad further comprises a plurality of contoured layers attached to the surface of said foam layer opposing said exposed surface.

* * * * *